US012747006B2

(12) United States Patent
Ehigh

(10) Patent No.: US 12,747,006 B2
(45) Date of Patent: Sep. 29, 2026

(54) GUNNEL GUARD AND WORKSPACE

(71) Applicant: Lumablu, LLC, Oregon City, OR (US)

(72) Inventor: Lane Ehigh, Oregon City, OR (US)

( * ) Notice: Subject to any disclaimer, the term of this patent is extended or adjusted under 35 U.S.C. 154(b) by 396 days.

(21) Appl. No.: 18/487,349

(22) Filed: Oct. 16, 2023

(65) Prior Publication Data

US 2024/0124105 A1 Apr. 18, 2024

Related U.S. Application Data

(60) Provisional application No. 63/416,317, filed on Oct. 14, 2022.

(51) Int. Cl.
*B63B 59/00* (2006.01)

(52) U.S. Cl.
CPC ..... *B63B 59/00* (2013.01)

(58) Field of Classification Search
CPC ..... B63B 59/00
See application file for complete search history.

(56) References Cited

U.S. PATENT DOCUMENTS

| | | | | |
|---|---|---|---|---|
| 1,257,073 | A * | 2/1918 | Frank | B63B 17/00 114/364 |
| 2,729,016 | A * | 1/1956 | Morris | A01K 97/20 248/95 |
| 5,143,354 | A * | 9/1992 | Nolan | E04H 17/003 256/11 |
| 6,834,609 | B2 * | 12/2004 | Cannon, Jr. | B63B 17/00 114/364 |
| 7,004,100 | B1 * | 2/2006 | Rard | B63B 34/26 114/364 |
| 11,685,476 | B2 * | 6/2023 | McGarian | B63B 17/04 114/364 |

* cited by examiner

*Primary Examiner* — Marc Q Jimenez
*Assistant Examiner* — Jovon E Hayes
(74) *Attorney, Agent, or Firm* — Chernoff, Vilhauer LLP

(57) ABSTRACT

Apparatuses for protecting the gunnel of a boat are disclosed. In one embodiment, the apparatus may include a planar platform and a first panel attached to, or formed with, the planar platform. The first panel may extend perpendicularly away from the planar platform. The apparatus additionally may include a second panel attached to, or formed with, the planar platform. The second panel may extend perpendicularly away from the planar platform and may be parallel to the first panel. The first and second panels may define a gap therebetween sized to receive the gunnel or rail of the boat to allow the apparatus to be supported on the gunnel or rail of the boat.

12 Claims, 10 Drawing Sheets

GUNNEL GUARD AND WORKSPACE

CROSS-REFERENCE TO RELATED APPLICATIONS

This application claims the benefit of U.S. Provisional Patent Application No. 63/416,317, which was filed on Oct. 14, 2022 and entitled "Gunnel Guard and Workspace." The complete disclosure of the above application is hereby incorporated by reference for all purposes.

BACKGROUND

The present disclosure relates to an accessory for boats that protects the gunnel (also spelled "gunwale") of a boat against scratches and other physical damage and provides additional workspace for the occupants of the boat.

Recreational, scientific, commercial, and other boaters may need to work over the sides of their boat to access items on a dock or in the water. For example, shellfish pots must be set with bait and then sunk to the bottom of a body of water. The pots are often heavy-commercial crab pots can way up to 700 pounds-so boaters often rest them on the gunnel of the boat before pushing them in the water. The pots are usually attached to ropes and buoys which allow for retrieval of the pots. As the shellfish pot sinks, the rope will follow it off the boat, sliding over the edge of the gunnel. When it is time to recover the pot, it may be heavier due to the number of shellfish caught, and recovery may necessitate moving the pot onto the gunnel before getting it completely on board. Setting the shellfish pot on the gunnel, sliding it off into the water, recovering the pot, and the rope sliding across the gunnel all contribute to wear on the gunnel. Others, such as fisherman, may need additional workspace on which they can easily tie knots, clean fish, or any number of other activities that are more easily undertaken with additional surface area on which to work.

What is desired then, is a boat accessory that both protects the gunnel from wear and provides additional workspace for boaters.

BRIEF DESCRIPTION OF THE DRAWINGS

For a better understanding of the invention, and to show how the same may be carried into effect, reference will now be made, by way of example to the accompanying drawings, of which.

DETAILED DESCRIPTION OF PREFERRED EMBODIMENTS

Figure 1:
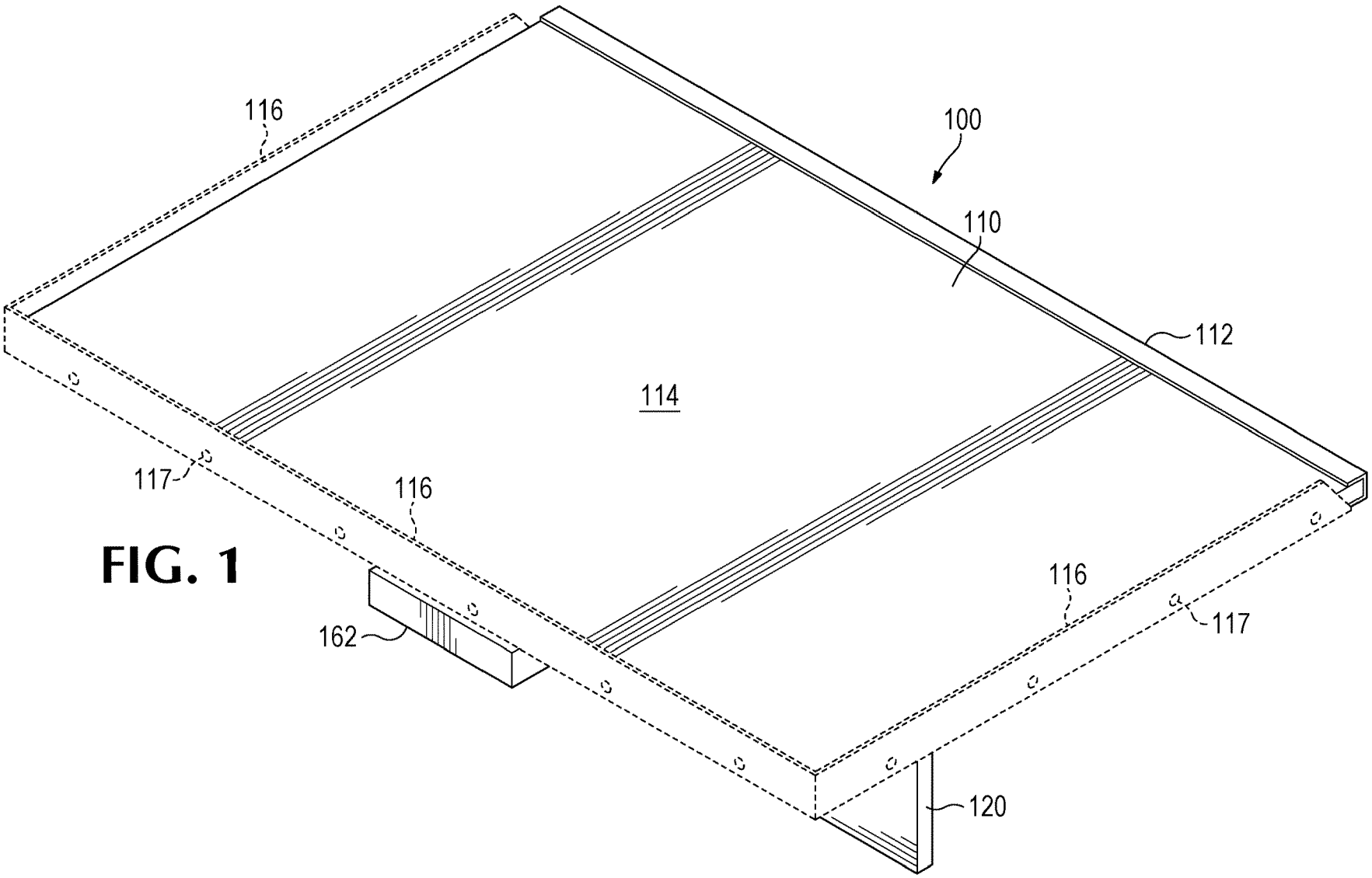
FIG. 1 is an isometric view of an example of a gunnel guard of the present disclosure.
Figure 2:
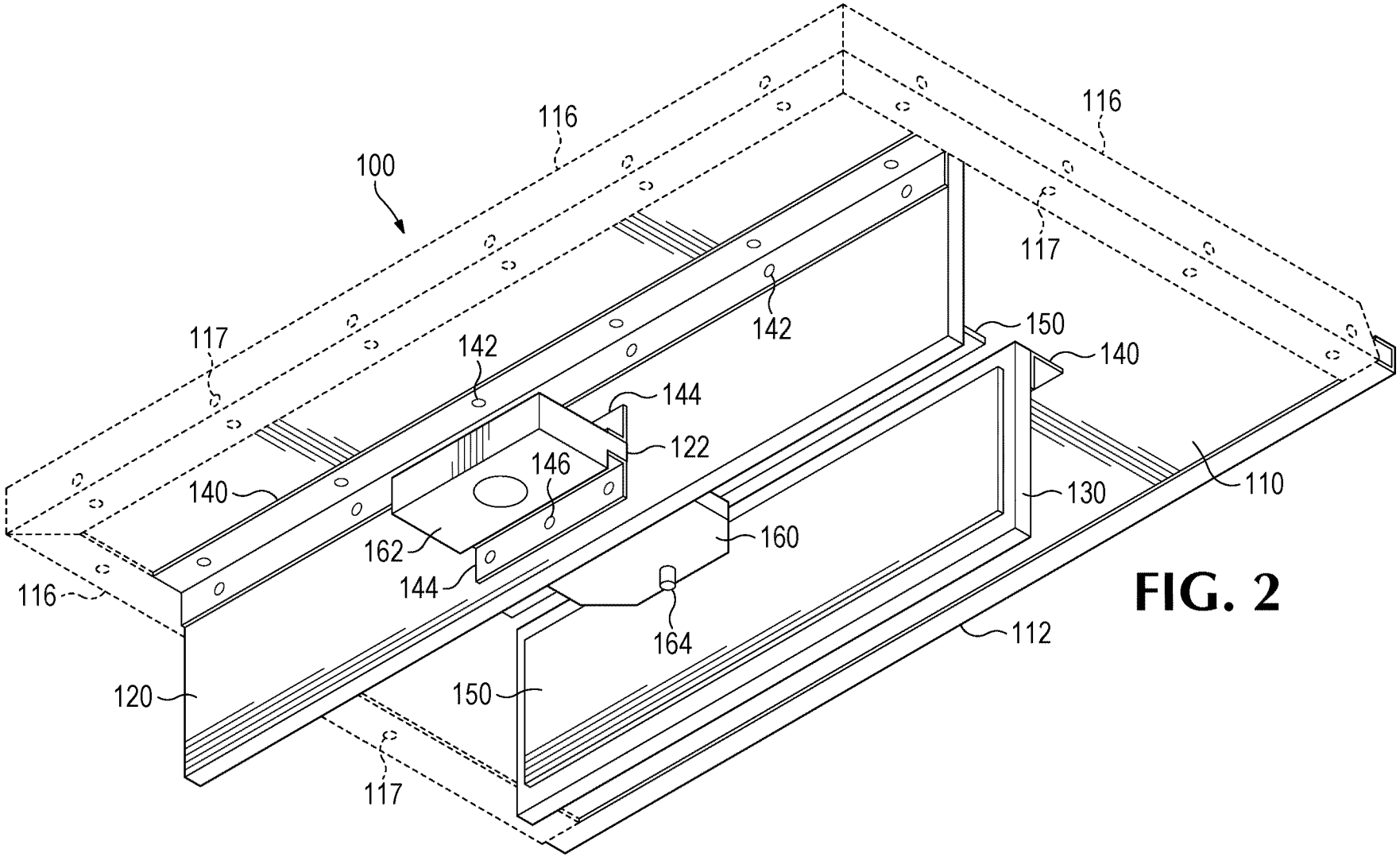
FIG. 2 is another isometric view of the gunnel guard of FIG. 1.
Figure 3:
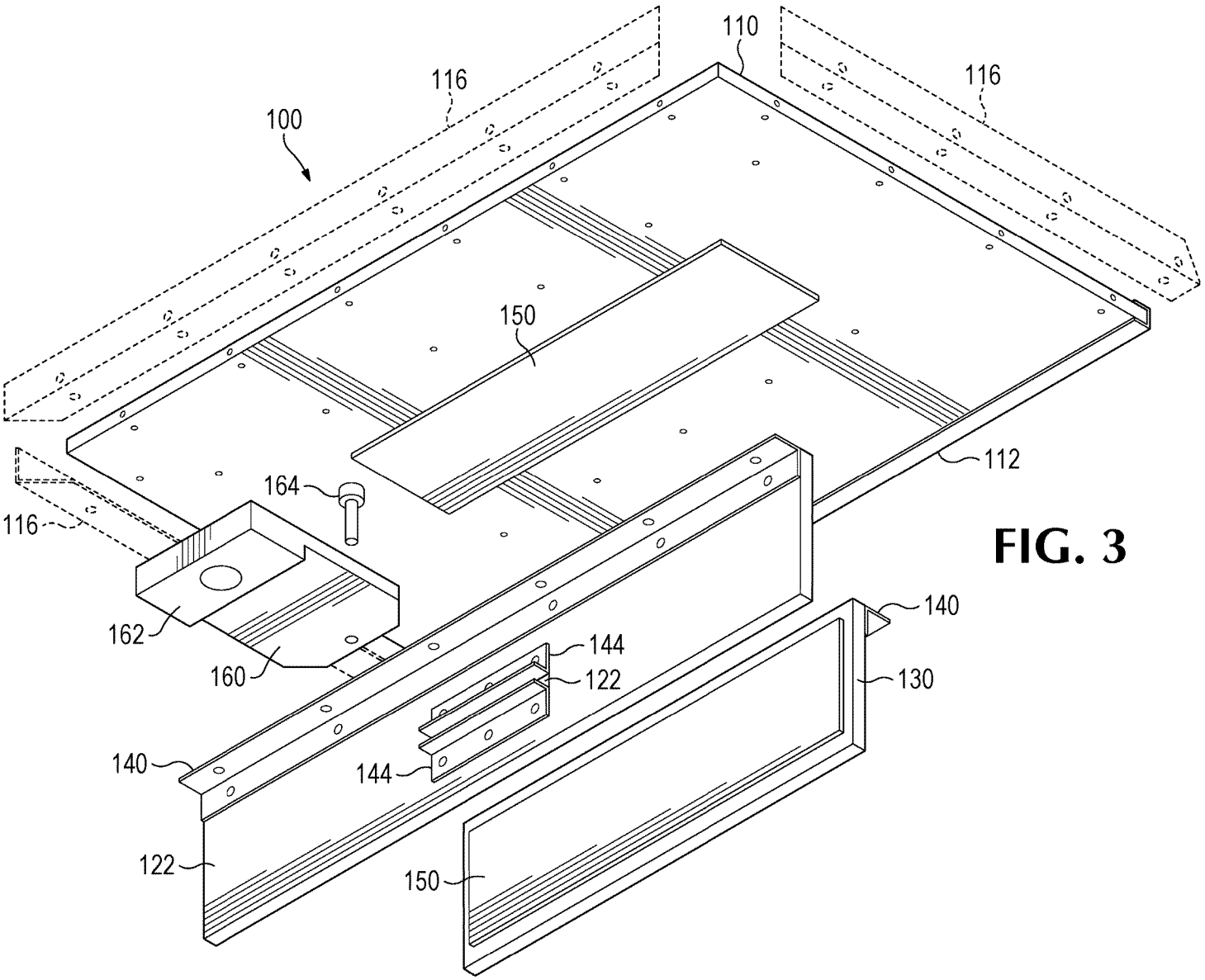
FIG. 3 is an exploded view of the gunnel guard of FIG. 1.

Referring to FIGS. 1-3, an illustrative example of a gunnel guard 100 is shown. Unless explicitly excluded, gunnel guard 100 may additionally, or alternatively, include one or more other components of the gunnel guards of the present disclosure. The gunnel guard 100 includes a platform 110 that, when mounted to a gunnel 220 of a boat 200, is preferably horizontally oriented with respect to the hull 210 of the boat 200, presuming the boat 200 is upright. The depicted platform 110 is made of a single piece of high-density polyethylene ("HDPE") shaped into a rectangle that is 36 inches by 24 inches by 0.5 inches. Other embodiments, however, need not adhere to these dimensions or materials; the platform 110 is preferably custom sized to the boat 200 on which it is used. The edges of platform 110 are preferably lined with U-channel brackets 112 to protect the edges of platform 110. Alternatively, or additionally, the edges of platform 110 may be lined with L-channel brackets 116 attached via fasteners 117 to provide an added top edge to prevent pots and other things from sliding out and/or keep debris out of the platform. Although the example shown in FIGS. 1-3 includes a single U-channel bracket 112 for one edge and three L-channel brackets 116 for the other three edges, platform 110 may include any suitable number of U-channel and/or L-channel brackets. The U-channel brackets 112 and/or L-channel brackets 116 are preferably made of marine-grade aluminum, which does not rust, but any material suitable to protect the edges of the platform 110 will do.

The platform 110 of FIGS. 1-3 defines an upper surface 114. The upper surface 114 of the illustrative example of FIGS. 1-3 is flat for use as a table top or work bench, but other embodiments may include any number of other modifications. For example, the platform 110 may have pockets or recesses for holding a variety of items attached; or it may have one or more rings or open channels which may guide a rope to a preferred point of contact with the platform 110 as it slides across. The platform 110 may include clamp arms configured to secure items to the gunnel guard 100 or the platform 110 may include fishing rod holders. The platform 110 may also be wider than the gunnel 220, extending over the side of the boat 200, back into the boat 200, or both. In contrast, it may be the exact width of the gunnel 220, adding no additional workspace, but reducing its overall size while still protecting the gunnel 220 and hull 210 of the boat 200. The platform 110 may also include containers for storing items.

Figure 6:
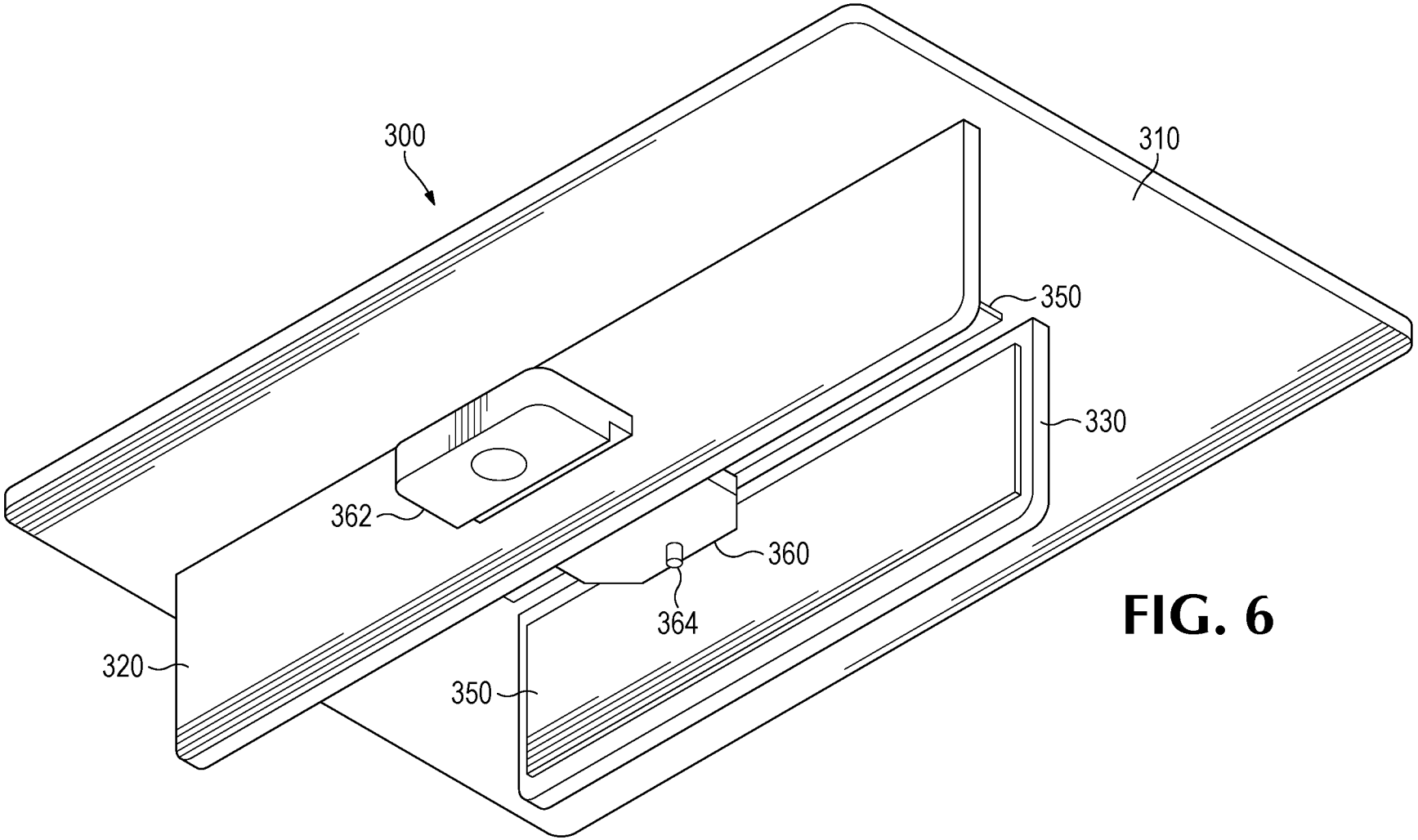
FIG. 6 is an isometric view of another example of a gunnel guard of the present disclosure.

Affixed to the underside of the platform 110 of FIGS. 1-3, which is also preferably flat, are a first board or panel 120 and a second board or panel 130, both of which may extend perpendicularly away from the underside of the platform 110. When mounted on the gunnel 220 of a boat 200, the first panel 120 preferably extends down past the upper surface of the gunnel 220 and into the boat 200, and the second panel 130 may extend down past the upper surface of the gunnel 220 but remain outside the boat's hull 210. However, other embodiments may have the first panel 120 outside the hull 210 and the second panel inside the hull 210. The first panel 120 and second panel 130 of the illustrative example of FIGS. 1-3 are preferably attached to the platform 110 by way of angle brackets 140, which are preferably made of marine grade aluminum, secured in place by fasteners 142 such as screws or nails. However, other methods of attachment may be present in other embodiments, as further discussed below. Further, the first panel 120 and/or the second panel 130 may be formed with the platform 110, such that all three are a single article, such as shown in FIG. 6.

When mounted on a gunnel 220 in a preferred method, the combination of the platform 110, the first panel 120, and the second panel 130 may abut the gunnel 220 and hull 210 of the boat 200 such that the gunnel guard 110 cannot slide off the gunnel 220 and is limited in how much it can rotate around the gunnel 220. The platform 110 preferably rests on the gunnel 220. The preferred position of the first panel 120 within the boat's hull 210 prevents the gunnel guard 100 from sliding off the gunnel 220 out of the boat 200 by abutting the interior of the hull 210. The first panel 120 also limits the rotational distance of the gunnel guard 100 by abutting the interior of the hull 210 and preventing rotation into the boat 200. Likewise, the preferred position of the second panel 130 on the outside of the hull 210 prevents the gunnel guard 100 from sliding into the boat 200 and limits the rotational distance of the gunnel guard 100 towards the out of the boat 200 by abutting the exterior of the hull 210 to limit sliding or rotational movement.

Figure 4:
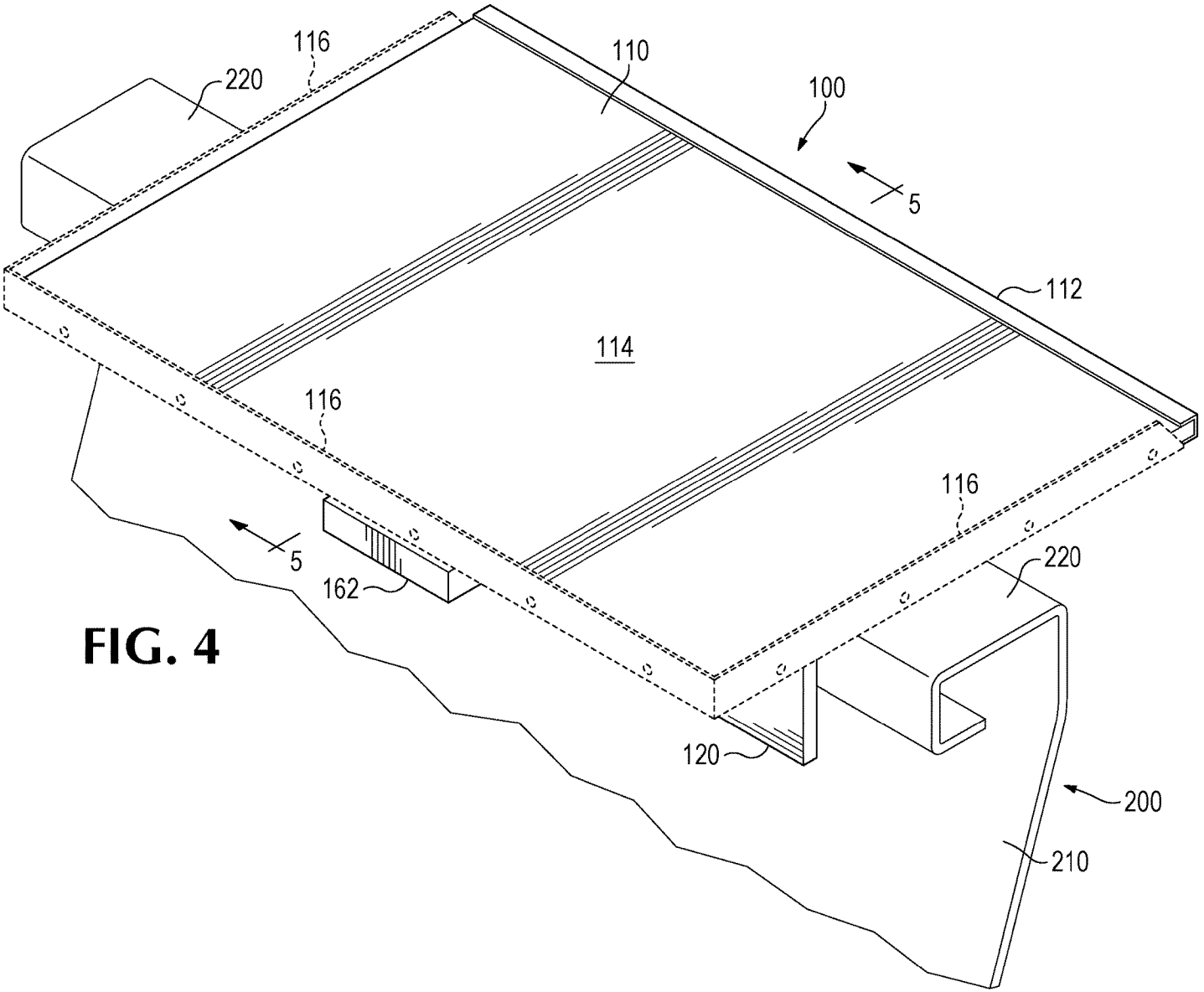
FIG. 4 is an isometric view of the gunnel guard of FIG. 1 attached to an example of a gunnel of a boat.
Figure 5:
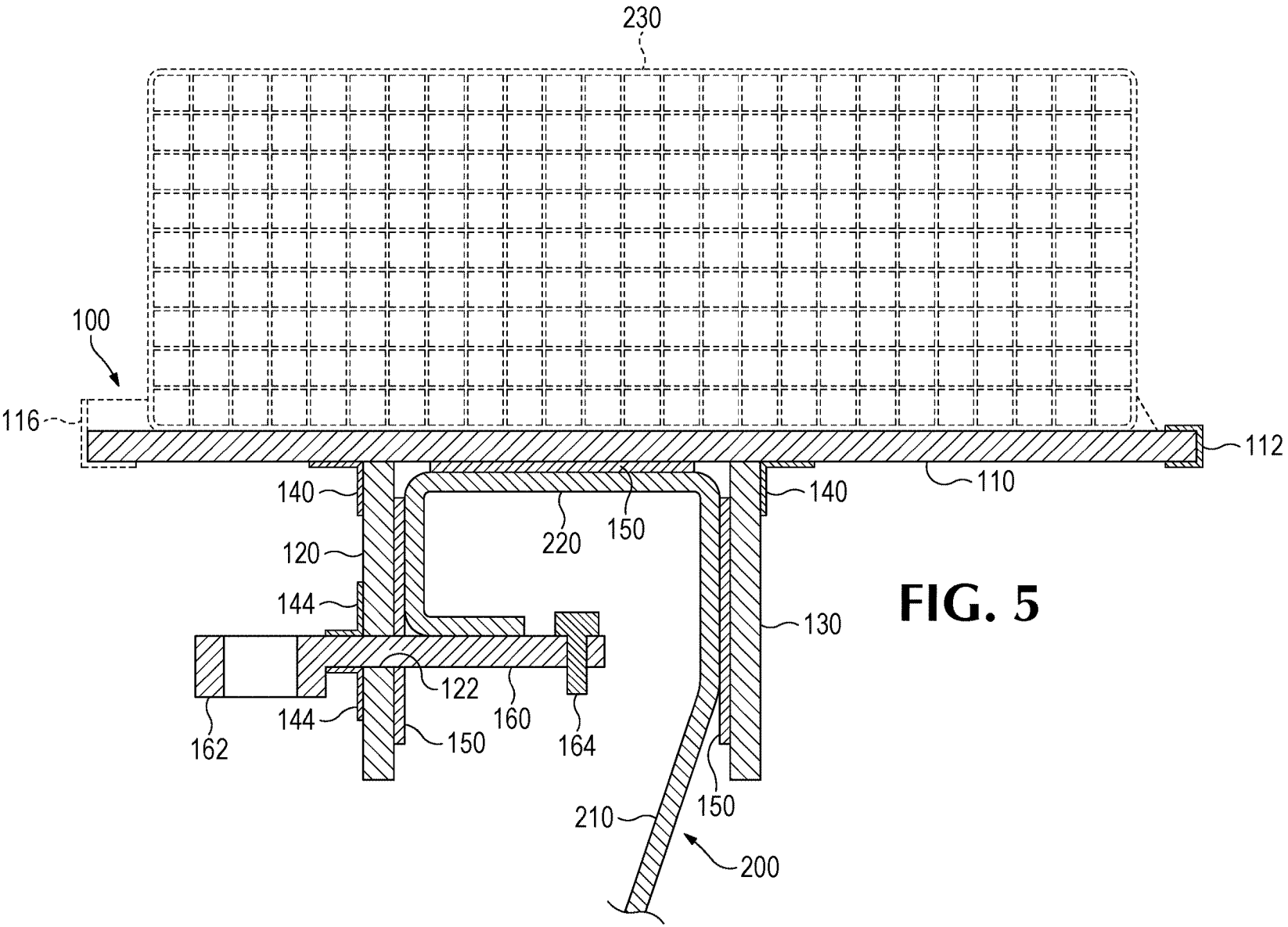
FIG. 5 is a sectional view of the gunnel guard of FIG. 1 attached to the gunnel of FIG. 4 taken along lines 5-5 in FIG. 4.

The first panel 130 of the illustrative example in FIGS. 1-3 also preferably includes a slot or opening 122 which extends at least part way through the first panel 130. A securing board or member 160 may be inserted into or through the opening 122. The securing member 160 preferably extends underneath the gunnel 220 of a boat 200 to prevent a mounted gunnel guard 100 from being lifted off the gunnel 220 by abutting the underside of the gunnel 220 and arresting upward movement when upward force is applied to the gunnel guard 100, as shown in FIGS. 4-5. The opening 122 may also or alternatively be present in the second panel 130. The securing member 160 may include an obstructing board or member 162 that prevents the securing member 160 from passing all the way through the opening 122, such as an oversized end portion that is sized larger than opening 122. Alternatively, obstructing member 162 may be attached to a longitudinal end of the securing member. The securing member 160 may also include a pin 164 or other device to prevent the securing member 160 from sliding back out from the opening 122. As best shown in FIG. 5, the platform, the first panel, the second panel, and the securing member contact four sides of the gunnel and/or enclose the gunnel to secure the platform to the gunnel. However, other embodiments may contact three or less sides of the gunnel and/or may partially enclose the gunnel. Various other embodiments may include alternative methods of securing the gunnel guard 100 to the gunnel 220 of a boat 200. For example, a chain may connect the gunnel guard 100 to the deck of the boat 200.

In the illustrative example of FIGS. 1-3, padding 150 may be attached the underside of the platform 110 and the gunnel-facing sides of the first and second panels 120, 130 where the platform 110 and first and second panels 120, 130 abut the gunnel 220 or hull 210 of the boat 200. The padding 150 is preferably made of Ethylene-Vinyl Acetate ("EVA") foam, such as that manufactured by SeaDek®, but it may be made of any material suitable for preventing scratches and other damage or blemishes to the hull 210 or gunnel 220 of the boat 200. When installed, as shown in FIGS. 4-5, platform 110 may be used to support materials 230, such as a shellfish pot.

Figure 7:
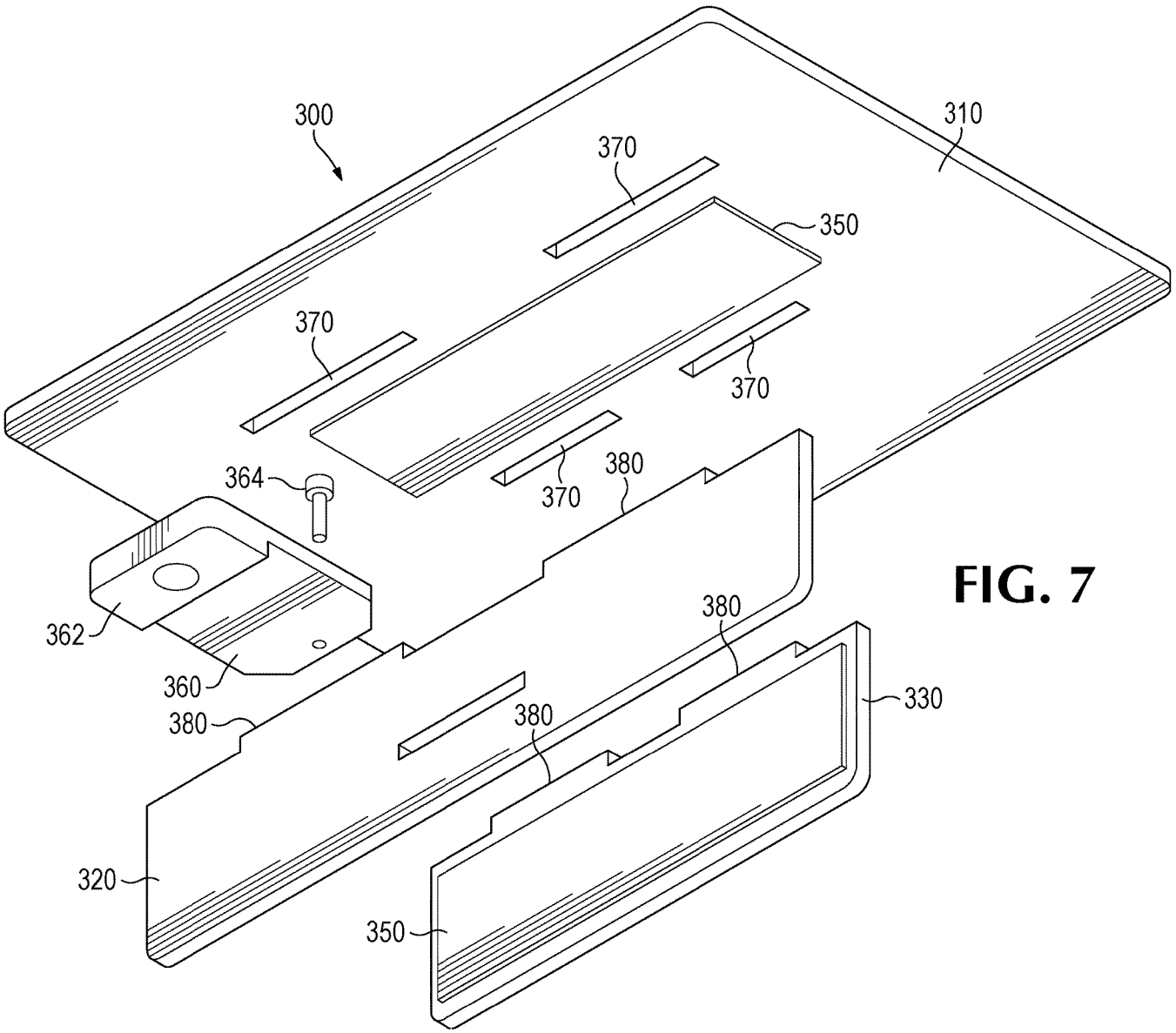
FIG. 7 is an exploded view of an additional example of a gunnel guard of the present disclosure.

Referring now to FIG. 7, a second illustrative example of the gunnel guard 100 of the present disclosure is shown at 300. Unless explicitly excluded, gunnel guard 300 may additionally, or alternatively, include one or more components of one or more of the other gunnel guards of the present disclosure. The embodiment uses a mortise-and-tenon method of attaching a first panel 320 and a second panel 330 to a platform 310. In this illustrative embodiment, the platform 310 defines one or more mortises 370 which correspond to one or more tenons 380 defined by the first and/or second panels. The one or more tenons 380 are inserted into the one or more mortises 370, and the platform 310 and the first and/or second panels are then affixed to one another using one or more methods. The illustrative example of FIG. 7 uses fasteners 342, such as screws, but other methods may be used instead of or in conjunction with fasteners. For example, the one or more mortises 370 and the one or more tenons 380 may be bonded by way of adhesive, cement, or binding agent.

Figure 8:
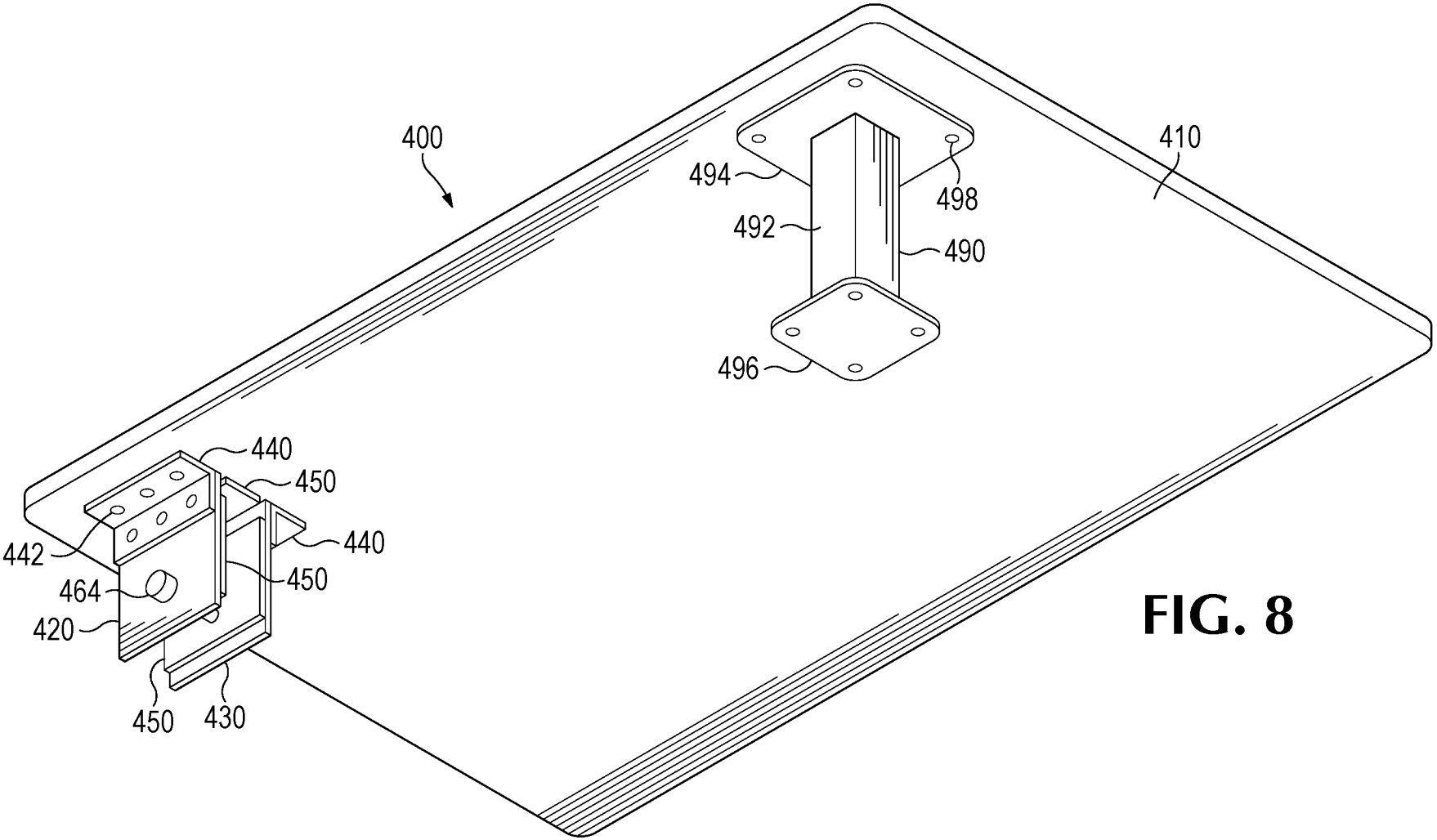
FIG. 8 is an isometric view of a further example of a gunnel guard of the present disclosure.
Figure 9:
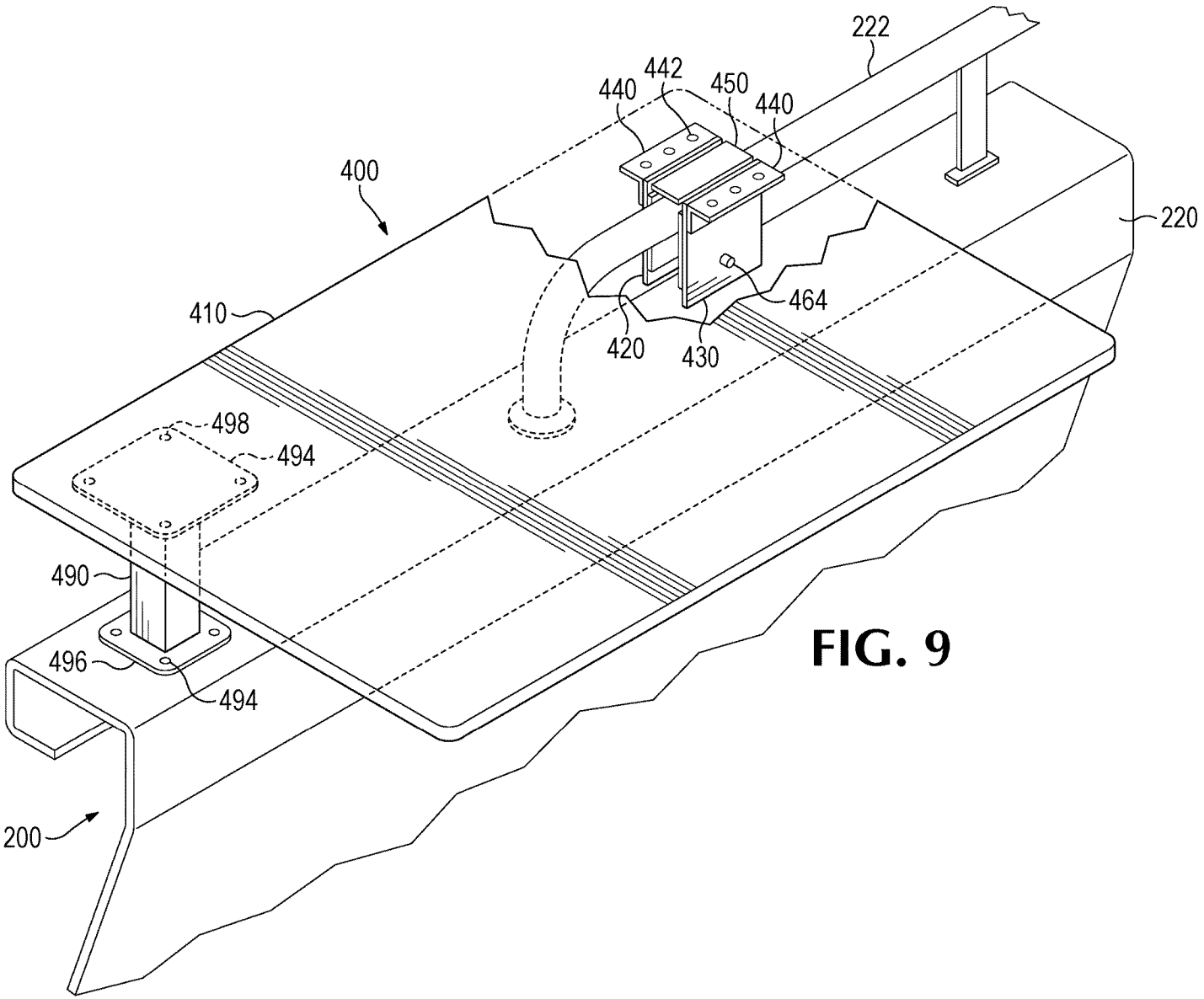
FIG. 9 is an exploded view of the gunnel guard of FIG. 8.
Figure 10:
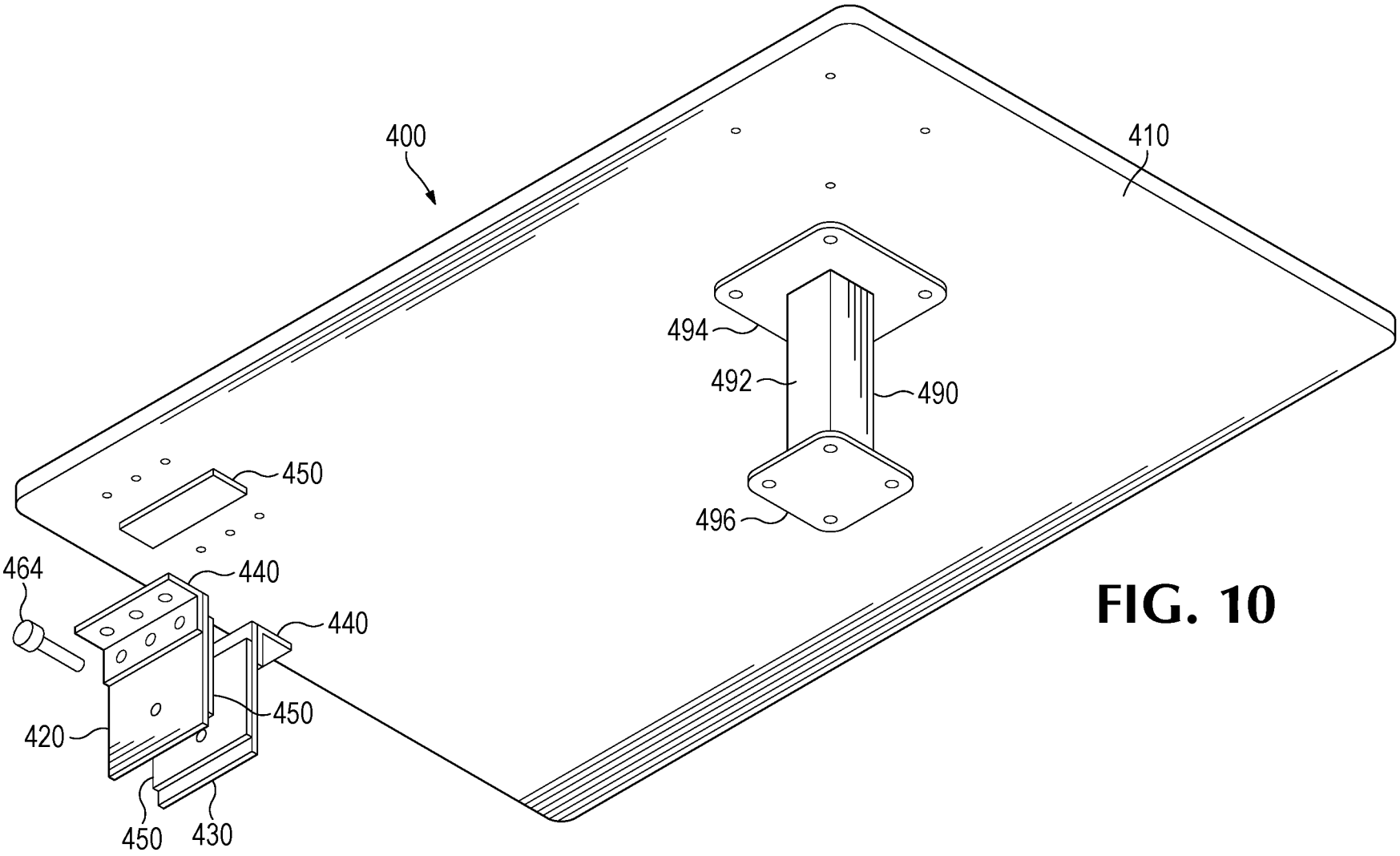
FIG. 10 is an isometric view of the gunnel guard of FIG. 8 attached to an example of a gunnel of a boat.

Referring now to FIGS. 8-9, a third illustrative example of the gunnel guard 100 of the present disclosure is shown at 400. Unless explicitly excluded, gunnel guard 400 may additionally, or alternatively, include one or more components of one or more of the other gunnel guards of the present disclosure. Gunnel guard 400 is particularly suitable for small spaces and/or where the boat 200 has an additional rail 222 on its gunnel 220 (as shown in FIG. 10). Unlike the previous gunnel guards, gunnel guard 400 includes first and second panels 420 and 430 that are smaller and closer together to accommodate the smaller rail. Additionally, a pin 464 is received in openings 422 of both the first and second panels and there is no securing member used. Similar to the previous examples, the first and/or second panels may be attached to platform 410 via any suitable methods (e.g., via brackets 440) and pads 450 may be attached to platform 410 and first and/or second panels 420 and 430.

Unlike the previous gunnel guards, gunnel guard 400 includes a stand 490 having a base 492 and flanges 494 and 496 at the base's opposed longitudinal ends. The flanges may be in the form of brackets or plates, such as a Scotty® downrigger bracket or mounting plate model 1036. Flanges 494 and 496 may be attached to platform 410 and/or gunnel 220 via fasteners 498 (e.g., downrigger screws for attaching to gunnel 220).

Example Features

This section describes additional aspects and features of one or more gunnel guards, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing, without limitation, examples of some of the suitable combinations.

A1. An apparatus for protecting the gunnel of a boat comprising:

- a platform defining at least one flat surface, said flat surface defining that is level and coextensive with said flat surface;
- a first panel extending substantially perpendicularly away from said flat surface and away from said plane; and
- a second panel extending substantially perpendicularly away from said flat surface and away from said plane on the same side of said plane as said first panel;
- wherein said first panel and said second panel are spaced such that said platform may rest on a gunnel of a boat with one of said first panel or said second panel inside said boat and the other of said first panel or said second panel outside said boat.

A2. The apparatus of paragraph A1 wherein the width of said platform is greater than the width of said gunnel.

A3. The apparatus of paragraph A1 wherein said platform further comprises a flat upper surface.

A4. The apparatus of paragraph A1 wherein at least one of said first panel or said second panel further comprises an opening.

A5. The apparatus of paragraph A4 further comprising a securing member, insertable into said opening; wherein said apparatus is securable to a gunnel of a boat by insertion of said securing member into said opening.

A6. The apparatus of paragraph A5 wherein said securing member further defines an obstruction which prevents said securing member from passing all the way through said opening.

A7. The apparatus of paragraph A5 wherein said apparatus further comprises a pin and said securing member further defines a pinhole; wherein insertion of said pin into said pinhole prevents said securing member from sliding through said opening.

A8. The apparatus of paragraph A1 further comprising padding positioned to protect said gunnel of said boat from said platform, said first panel, and said second panel.

A9. The apparatus of paragraph A1 wherein at least one of said first panel and said second panel are affixed to said platform with angle brackets.

A10. The apparatus of paragraph A1 wherein at least one of said first panel and said second panel are affixed to said platform with one or more mortise-and-tenon joints.

A11. The apparatus of paragraph A1 wherein at least one of said first panel and said second panel are formed with said platform.

A12. The apparatus of paragraph A1 wherein said platform further defines one or more edges and said one or more edges are covered by U-channel brackets.

A13. The apparatus of paragraph A1 wherein said platform is made of high-density polyethylene.

A14. The apparatus of paragraph A1 wherein said platform further comprises one or more openings, containers, and/or pockets for storing items.

A15. The apparatus of paragraph A1 wherein said platform further comprises a ring or channel for guiding rope through.

A15. The apparatus of paragraph A1 wherein said platform further comprises one or more fishing rod holders.

It will be appreciated that the invention is not restricted to the particular embodiments that have been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. An apparatus for protecting the gunnel or rail of a boat, comprising:

a planar platform;

a first panel attached to, or formed with, the planar platform, the first panel extending perpendicularly away from the planar platform; and a second panel attached to, or formed with, the planar platform, the second panel extending perpendicularly away from the planar platform and being parallel to the first panel, wherein the first and second panels define a gap therebetween sized to receive the gunnel or rail of the boat to allow the apparatus to be supported on the gunnel or rail of the boat, wherein the first and second panels are positioned on the platform such that, when the apparatus is supported on the gunnel of the boat, the first and second panels contact opposed sides of the gunnel of the boat.

2. The apparatus of claim 1, wherein the first panel includes an elongate slot, and the apparatus further comprising a securing member removably received in the elongate slot.

3. The apparatus of claim 2, wherein the securing member includes opposed first and second longitudinal ends, the first longitudinal end being sized to be received in the elongate slot and the second longitudinal end being sized larger than the elongate slot.

4. The apparatus of claim 3, wherein the second longitudinal end includes a hole, further comprising a pin received in the hole to prevent removal of the securing member from the elongate slot.

5. The apparatus of claim 1, wherein the first and second panels each includes a hole positioned to receive a single elongate pin.

6. The apparatus of claim 1, further comprising a stand having a base and first and second flanges on opposed longitudinal ends of the base, the first flange being attached to the platform, and the second flange capable of being attached to the gunnel of the boat.

7. The apparatus of claim 1, wherein, when the apparatus is supported on the gunnel of the boat, the securing member contacts a third side of the gunnel.

8. The apparatus of claim 1, wherein the platform includes a plurality of mortises and one or both the first and second panels includes a plurality of tenons that correspond to the plurality of mortises.

9. The apparatus of claim 1, wherein the first and second panels are attached to the platform via angle brackets.

10. An apparatus for protecting the gunnel or rail of a boat, comprising:

a planar platform;

a first panel attached to, or formed with, the planar platform, the first panel extending perpendicularly away from the planar platform; and a second panel attached to, or formed with, the planar platform, the second panel extending perpendicularly away from the planar platform and being parallel to the first panel, wherein the first and second panels define a gap therebetween sized to receive the gunnel or rail of the boat to allow the apparatus to be supported on the gunnel or rail of the boat, wherein the first and second panels each includes a hole positioned to receive a single elongate pin.

11. The apparatus of claim 10, further comprising a stand having a base and first and second flanges on opposed longitudinal ends of the base, the first flange being attached to the platform, and the second flange capable of being attached to the gunnel of the boat.

12. An apparatus for protecting the gunnel or rail of a boat, comprising:

a planar platform;

a first panel attached to, or formed with, the planar platform, the first panel extending perpendicularly away from the planar platform; and a second panel attached to, or formed with, the planar platform, the second panel extending perpendicularly away from the planar platform and being parallel to the first panel, wherein the first and second panels define a gap therebetween sized to receive the gunnel or rail of the boat to allow the apparatus to be supported on the gunnel or rail of the boat, wherein the platform includes a plurality of mortises and one or both the first and second panels includes a plurality of tenons that correspond to the plurality of mortises.

* * * * *